United States Patent [19]

Grice, Jr.

[11] 4,163,927

[45] Aug. 7, 1979

[54] AUTO-LEVELER CIRCUIT

[75] Inventor: Karl R. Grice, Jr., Honea Path, S.C.

[73] Assignee: Fiber Controls Corporation, Gastonia, N.C.

[21] Appl. No.: 793,759

[22] Filed: May 4, 1977

[51] Int. Cl.[2] ..... H02P 5/46; D02H 5/38

[52] U.S. Cl. ..... 318/68; 318/432; 19/240

[58] Field of Search ..... 318/66, 67, 68, 69, 318/70, 71, 72, 432, 433; 19/240

[56] References Cited

U.S. PATENT DOCUMENTS

| | | | |
|---|---|---|---|
| 3,742,321 | 6/1973 | Bergman et al. | 318/72 X |
| 3,938,223 | 2/1976 | Grice | 19/240 |
| 4,099,297 | 7/1978 | Hasegawa et al. | 19/240 |

*Primary Examiner*—B. Dobeck

*Attorney, Agent, or Firm*—Cushman, Darby & Cushman

[57] ABSTRACT

A circuit for controlling the speed of a feed roller in a card or the like in which the sliver thickness is detected and a signal produced which is combined with signals representing feed and doff roller speeds, and a signal representing feed motor torque. The resulting signal is compared with a ramp signal to drive the feed motor so as to maintain sliver thickness at a desired value.

12 Claims, 5 Drawing Figures

AUTO-LEVELER CIRCUIT

BRIEF DESCRIPTION OF THE BACKGROUND OF THE INVENTION AND SUMMARY OF THE INVENTION

The invention relates to a circuit for maintaining constant sliver density and thickness in a card or the like.

One step in the processing of textile fibers, such as cotton, wool, synthetic fibers or any type of textile fibers is forming these small fibers into a long inter-lock chain known in the art as a sliver. This function is usually accomplished by a machine termed a card, but other textile processing equipment such as draw-frames and pin drafters also produce slivers. These slivers are conventionally coiled or otherwise stored for further processing into textile yarn or thread, which can then be woven or otherwise manipulated into textile material. It is important that the density or thickness of the sliver be maintained substantially uniform. In the absence of monitoring of this thickness or density, the sliver density has a tendency to drift away from a desired value, thus producing a product which is unsatisfactory for further processing. In view of the speed of operation of modern carding machines, it is virtually impossible for visual observation or periodic manual testing to satisfactorily maintain a desired density.

Thickness regulating devices commonly known by the term "autolevelers" are well-known in the textile art and have been successfully employed for many years. For example, Crossroll manufactures an autoleveler in which the relative positions of two rollers between which the sliver moves are detected to produce an electrical signal, which is integrated and compared electrically with a desired value to control the relative speeds of the doffer and feed rolls of the card machine. U.S. Pat. No. 3,938,223 describes an apparatus in which the thickness and density of a sliver passing between a rotating grooved roller and a sensor roller is detected by movement of a magnetic core to vary the coupling between primary and secondary windings of a transformer. Preferably the transformer includes first and secondary coils so that the amplitudes of the respective output voltages of these coils are directly related to the position of the core and, accordingly, the thickness of the sliver. The signals produced by the two secondary coils are delayed in time by a simple integration circuit to avoid changes in density resulting from detecting a minor irregularity in the sliver and applied to a first differential amplifier which produces an output voltage, which output voltage varies as a function of the difference between the two input signals.

The output voltage is in turn applied to a second differential amplifier which is periodically rendered operative by a pulse generator for a short period. The other input to the second amplifier is used to adjust the desired sliver thickness. When the second amplifier is activated, an amplified signal is applied to a pair of relays, one responsive to positive excursions of the wave form and the other responsive to negative excursions. Each of these relays operates a control switch which when the relays are activated completes a current path through a coil of a conventional control device which operates an armature to control a variable speed device connected to one of the two rollers which control the thickness of the sliver, for example, the feed roll of a conventional card.

In co-pending application Ser. No. 792,765 filed May 2, 1977, entitled AUTO-LEVELER an apparatus is described which is particularly useful for producing an electrical output signal which varies as a function of sliver thickness. As the sliver passes through a bore in a trumpet, the thickness is pneumatically sensed and a magnetic core shifted vertically in position with respect to a driven and a driving coil to produce an output signal. The disclosure of this co-pending application is hereby incorporated into the present application The present invention relates to a circuit which finds particular utility with an auto-leveler of the type described in the above-mentioned co-pending application. The circuit of the present invention produces particularly accurate and reliable control of the feed motor of a card or the like. Signals indicating the respective speeds of the doff and feed rollers are produced as positive and negative DC voltages respectively which are applied to the opposite ends of a resistor. A signal from a sensor indicating the sliver thickness is then added to the signal representing the difference in speed between the doff and speed rolls. That signal is in turn added to a signal representing the torque of the feed motor to produce a control signal which is then compared with a ramp signal to control the speed of the feed roller.

Other objects and purposes of the invention will become clear from the following detailed description of the drawings.

Figure 1:
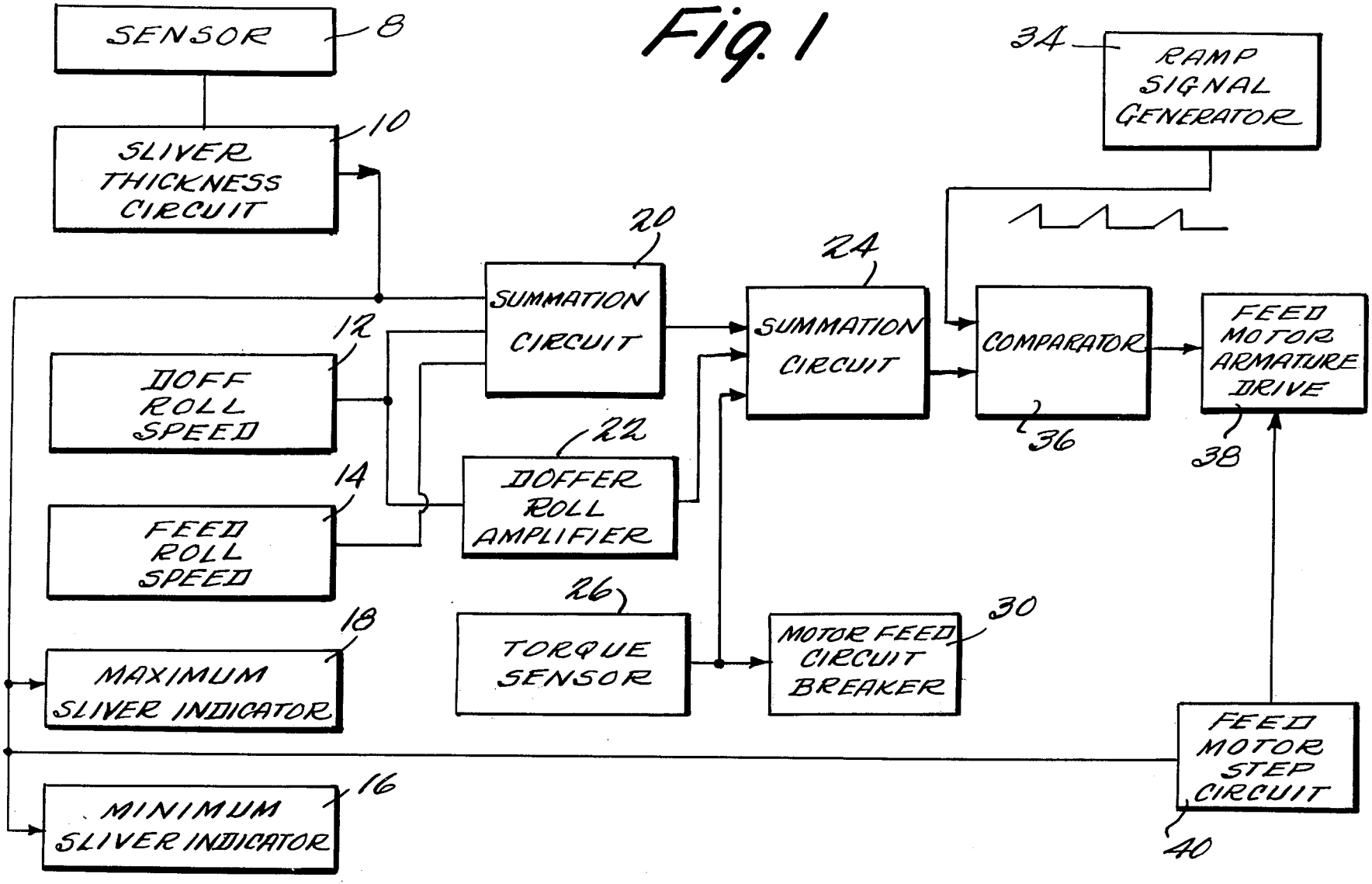
FIG. 1 shows a block diagram of one embodiment of the present invention.

FIGS. *2a–2d* show detailed schematics of the blocks in FIG. 1 with lines A–H extending between the figures.

DETAILED DESCRIPTION OF THE DRAWINGS

Reference is now made to FIG. 1 which illustrates in block diagram the elements of one embodiment of the circuit of the present invention. Circuit 10 is connected to a sensor 8 such as described in the above-mentioned co-pending application and which provides a signal indicating the thickness of a sliver of textile yarn passing, e.g., through a trumpet in a carding machine or similar structure. Circuit 10 produces an output signal which varies as a function of the sliver thickness.

The speed of a doff roll, such as conventionally found in a carding machine, is detected by any suitable means, for example, by detecting the movement past a ferromagnetic detector of ferrous metal of gearteeth rotating with the doff roll. Circuit 12 then produces a signal which varies as a function of the speed of the doff roll. Feed roll circuit 14 similarly produces a signal varying as a function of the feed roll. The difference in speed between the doff and speed rolls as indicated above determines the thickness of the sliver.

Sliver thickness circuit 10 is connected to the minimum sliver indicating circuit 16 which provides an indication when the sliver thickness falls below a given value and maximum sliver indicator 18 which provides a similar indication when the thickness is greater than a predetermined value. These indications may be an indication that the mechanism is malfunctioning and should be shut down before substantial amounts of useless slivers are produced.

The outputs of circuits 10, 12 and 14 are applied to a first summation circuit 20. Summation circuit 20 adds the signal from the sliver thickness circuit 10 to a signal which reflects the difference between the feed and doff roll speeds. The signal from doff roll 12 is also amplified in circuit 22 and the outputs of circuits 22 and 24 applied to a further summation circuit 24. Summation circuit 24 also receives a signal from a torque sensor 26 which produces a signal varying as a function of the sensed torque of the motor driving the feed roll. This sensor may simply be a resistor connected in series with a winding of the motor. Adding the signal from the torque sensor to the signals from summation circuit 20 and amplifier 22 increases the current to the armature when the torque requirements of the motor are high.

Ramp signal generator 34 produces a train of ramp signals which are applied to comparator circuit 36 together with the output of summation circuit 24. The output of summation circuit 24 defines a control signal which controls the signal applied to the feed motor armature drive circuit 38 and thus controls the current which flows through the armature and the speed of the feed roll. Feed motor stop circuit 40 is connected to the output of the sliver circuit for stopping the motor when the thickness deviates by more than a certain amount from a desired value.

Reference is now made to FIGS. *2a–2d* which illustrate detailed schematics of the various elements illustrated in block diagram in FIG. 1.

Sliver thickness circuit 10 (FIG. *2a*) includes a winding 100 which produces an output signal which varies as the function of the position of a magnetic portion which couples winding 100 to a driving coil, e.g., as disclosed in the co-pending application mentioned above. The signal produced at coil 100 is rectified by diodes 102 and 14. Capacitors 106 and 108 smooth the current induced in coil 100 and thus reduce the sensitivity of the circuit to minor and abrupt fluctuations in sliver thickness, while resistors 105 and 107 limit the charging currents to prevent rapid charging from lumps, etc. in the sliver.

Operational amplifier 110 amplifies the signal provided by coil 100, e.g., by a gain of ten, and the output of operational amplifier 110 is applied to operational amplifier 112 via a low pass filter circuit comprising capacitor 114 and resistor 116. Operational amplifier 112 acts as a high input impedance buffer for the filter network in order to achieve the integration or filter response time required, which time is typically 20 seconds to reach a level of 50% of the error signal level. Because of the integrator comprising capacitor 114 and resistor 116, the resulting error signal at the output of operational amplifier 112 varies positive and negative around a reference point near ground potential. Thus, a constant level correction signal is provided and not one which continues to increase in magnitude as long as the error exists. The correction given by the low-pass integrator comprising resistor 116 and capacitor 114 is proportional to the magnitude of the error only. The greater the error signal, the greater the correction applied.

If desired, a true integrating operational amplifier can be substituted for amplifier 112. In a closed loop system of that sort, however, the integrator tends to hunt and to overshoot because of lag time between correcting and detecting. At the same time better long term stability can be achieved.

The output of operational amplifier 112 represents a degree of needed correction due to sliver variation which is applied to summation circuit 20 (FIG. *2b*). A meter 120 is connected to the output of operational amplifier 112 in order to indicate the sliver thickness. Switch 124 permits the circuit 10 to be disconnected from summation circuit 20, and the circuit thus to be operated manually, i.e., without correction for detected sliver thickness. Diodes 126 and 128 limit the magnitude of the error signal which can be applied to summation circuit 20.

Turning now to the doff roller speed circuit 12 (FIG. *2b*) a magnetic pick-up is preferably located next to the doff gear so that winding 130 produces a train of pulses having a frequency proportional to the speed of rotation of the doff roll. Coil 130 is connected to operational amplifier 132 having resistors 134 and 136 connected as shown to provide a conventional squaring amplifier with hysteresis. The hysteresis is desirable to prevent small A.C. noise voltages from introducing spurious signals not representing gear teeth. Capacitor 137 connected to the output of amplifier 132 differentiates the output thereof so that only the edge of the waveform is used to determine the speed of the gear. The resulting signal is used to introduce a precise amount of charge to capacitor 137 via diode 140. Diode 142 clamps any positive pulse variation to ground in order to keep capacitor 136 from charging and biasing diode 140. Resistor 144 provides a discharge path for capacitor 138 to keep the D.C. signals produced in a linear response region. Thus, the signal produced at the junction between resistor 144 and resistor 150 is a negative D.C. voltage representing the speed of the doff roll. The speed of the doff roller is directly proportional to the production rate of the card.

Operational amplifier 152 is connected to coil 154 which produces a signal indicating the speed of the feed roll in the same fashion as circuit 12 as described above. Operational amplifier 152 thus provides a positive signal at the junction between resistor 154 and resistor 156, and, the potential across the serially connected resistors 154, 150 and 160 in effect represents the difference between the speeds of the doff and feed rolls. The output of operational amplifier 112 is supplied to the potentiometer 160 and to the negative input of operational amplifier 170, so that operational amplifier 170 produces an output which is the summation of the signal representing the sliver thickness and the signal representing the difference in speed between the doff and feed rolls. Should the doff speed roll increase, the voltage at the input to operational amplifier 170 will go more negative and cause the output of amplifier 170 to go more positive and result in an increase in speed of the feed roll. The feed roll will increase in speed again until the feed and doff rolls are once more in the proper ratio as set by manual adjustment of potentiometer 160. Thus, the doff speed and feed roll speed circuits provide an almost infinitely variable gear ratio system. Potentiometer 160 is normally adjusted such that the ratio between the doff roll speed and the speed roll speed is that required to produce the desired sliver weight while in manual operation, i.e., in operation without detecting the sliver thickness. This relieves the sliver sensing circuit of the chore of compensating speed variation due to changes in doff roll speed. Therefore, as long as the lap weight is constant into the feed rolls, these circuits produce a constant density sliver without the necessity of the sliver density signal.

The output of operational amplifier 170 is connected to operational amplifier 174 in second summation circuit 24 (FIG. 2*d*) which also receives a signal representing the torque of the feed motor and a signal representing the speed of the doff roller.

Figure 2A:
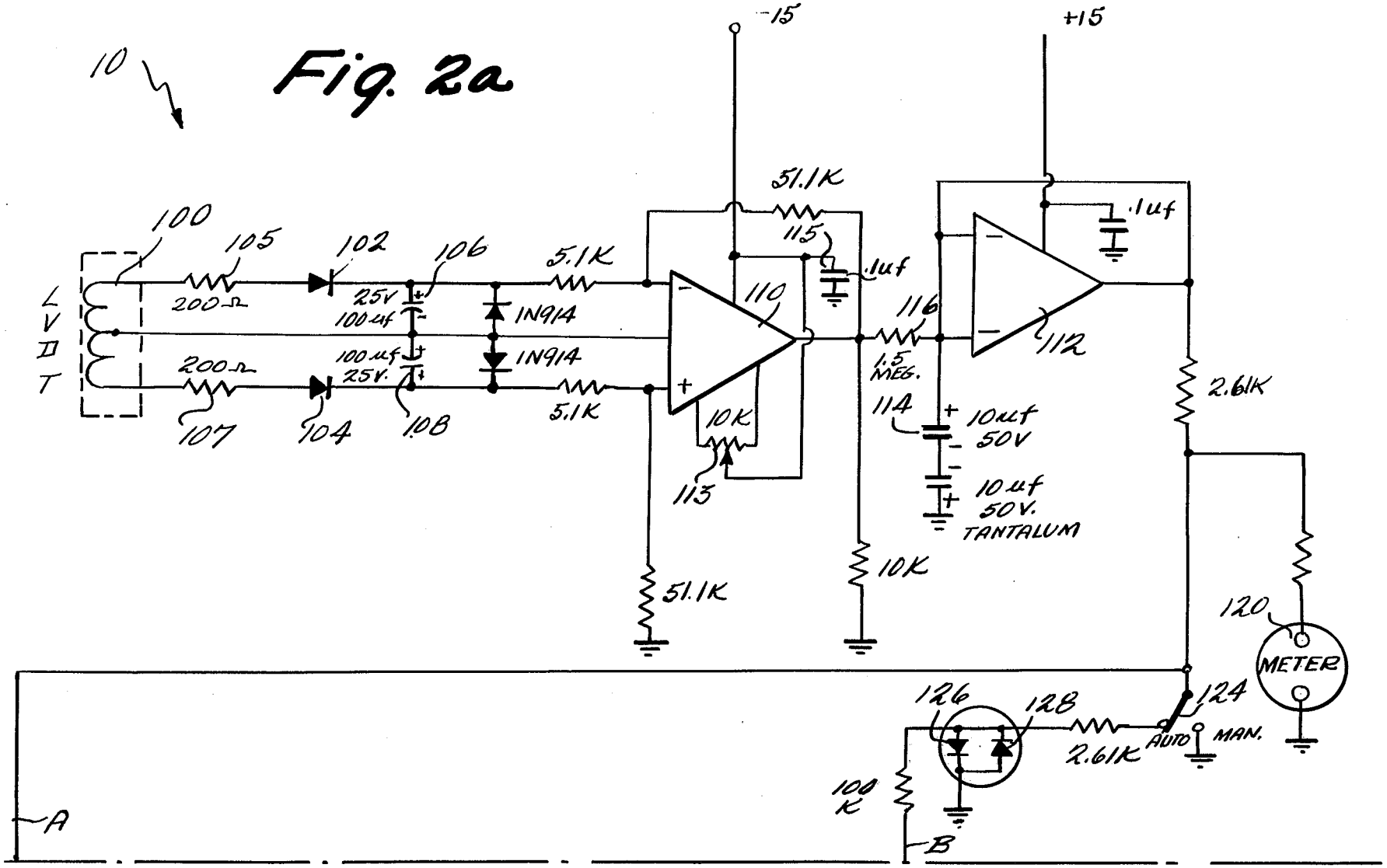
Figure 2B:
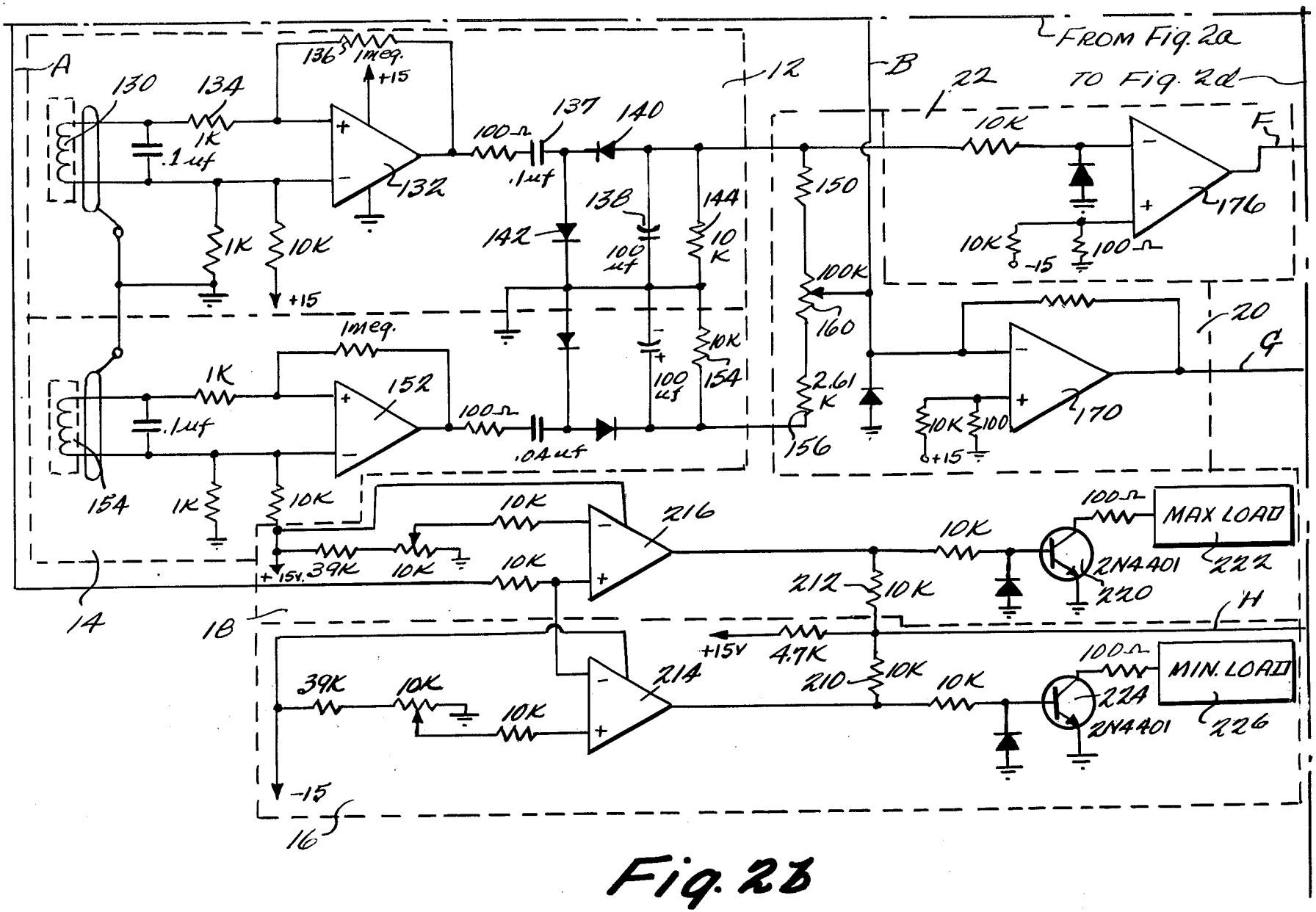
Figure 2C:
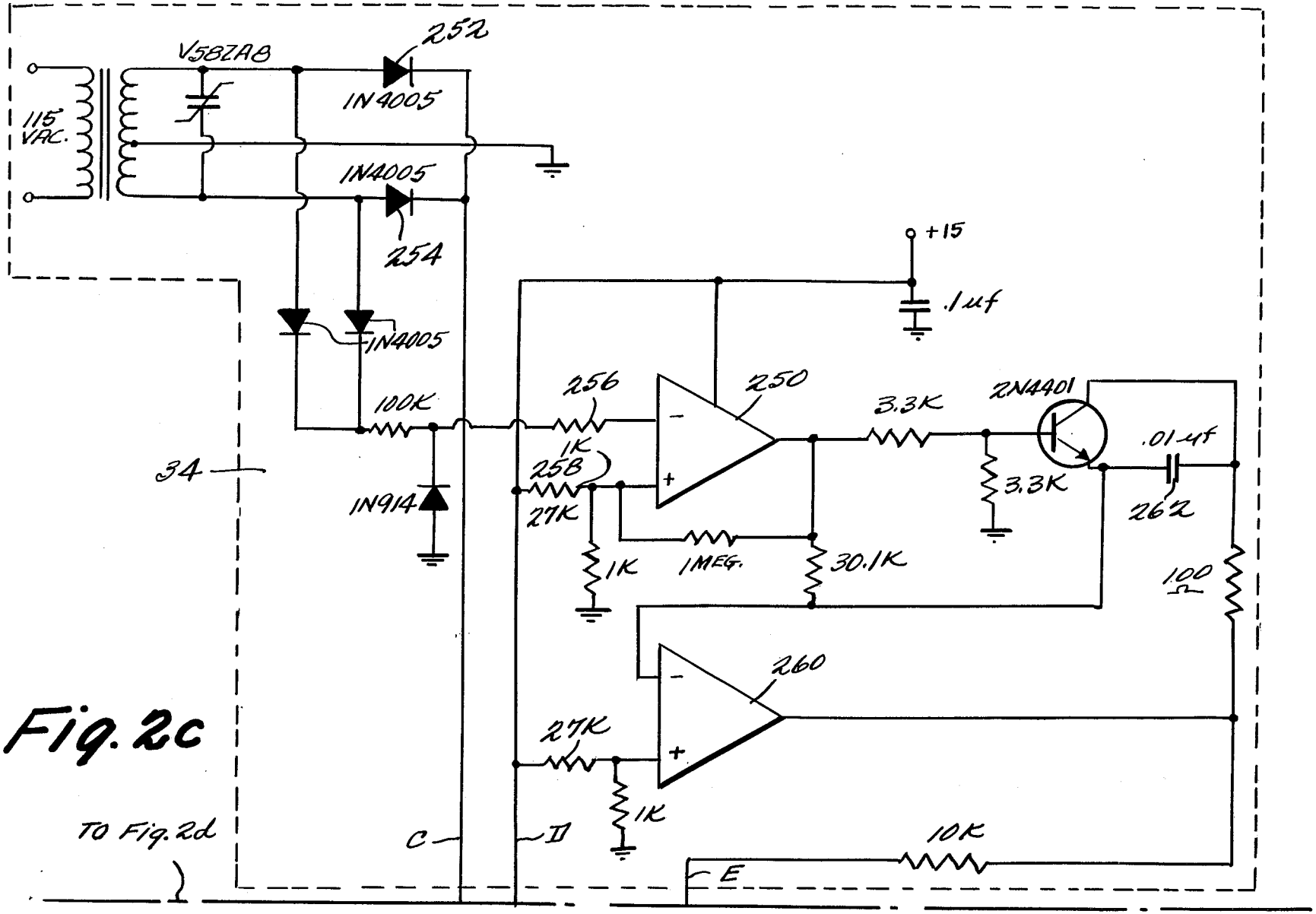
Figure 2D:
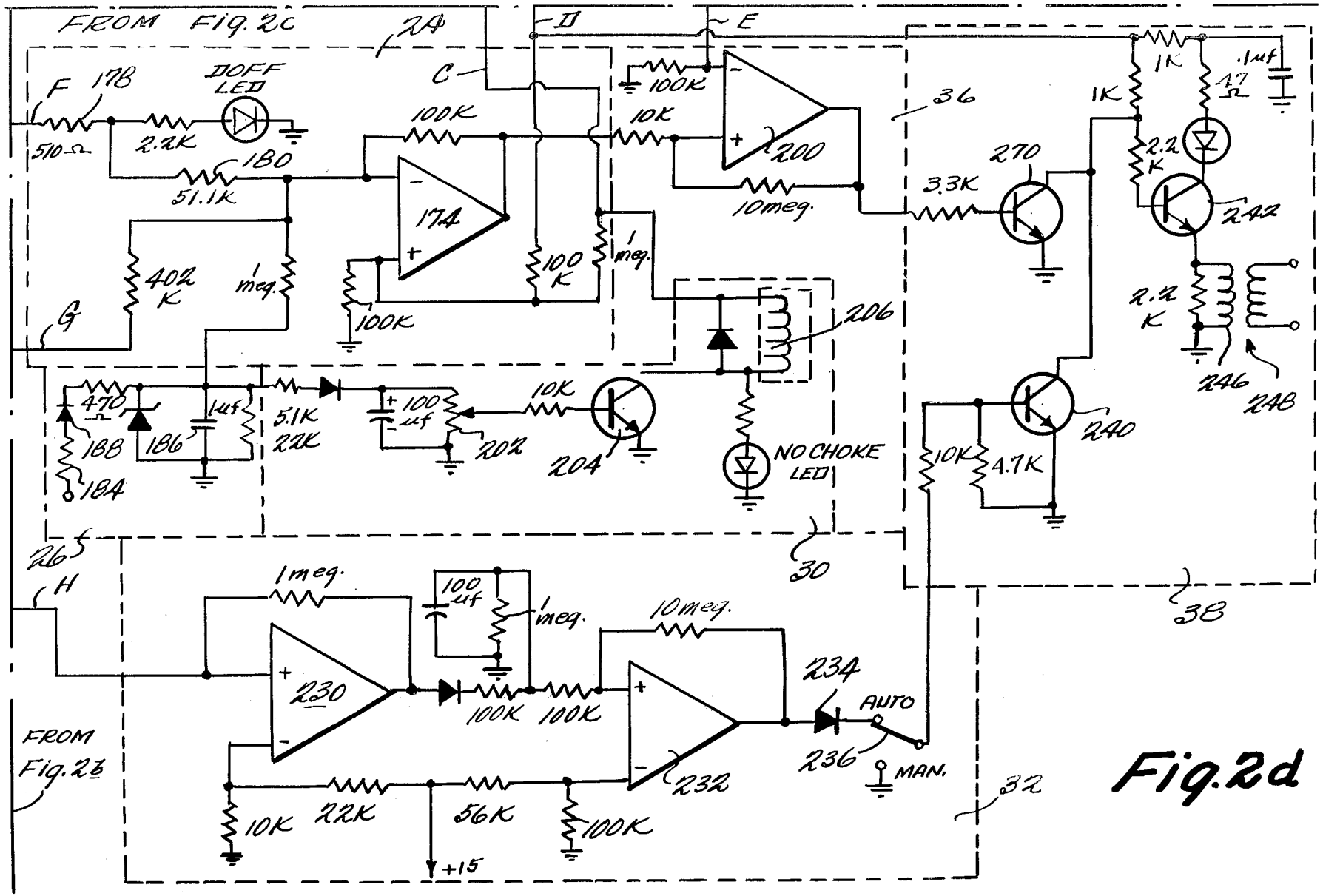

The signal appearing at the junction of resistors 144 and 150 (FIG. 2*b*) is applied to the negative input to operational amplifier 176 to provide an output which is applied via resistor 178 and 180 to negative input to operational amplifier 174 (FIG. 2*d*). The output of operational amplifier 170 is also applied to the negative input to operational amplifier 174.

Also applied to that input is a signal from a resistor 184 which is serially connected to a winding of the feed motor so that the voltage which is applied from resistor 184 to the negative input to operational amplifier 174 indicates the torque. Capacitor 186 filters the signal provided by resistor 184, which signal is rectified by diode 188, before applying the signal to the negative input to operational amplifier 174. Should the motor torque requirement increase due to an increase in lap density at the feed rolls, the voltage at capacitor 186 will become more positive. This will cause the output of operational amplifier 174 to become less positive. Operational amplifier 174 is connected to the positive input and operational amplifier 200 which is also connected to the ramp generating circuit 34 (FIG. 2*c*) and functions as a comparator. When operational amplifier 174 becomes less positive, comparator 200 causes additional current to flow through the motor to increase the torque output.

The output of operational amplifier 174 is also connected to a motor feed circuit breaker 30. When the voltage at capacitor 186 increases beyond the level set by the potentiometer 202, transistor 204 becomes conductive and current flows through circuit breaker coil 206 to cause the feed motor to cease operation before damage can occur.

The output of operational amplifier 200 is also connected to the drive circuit 38 which controls the current flow through the armature winding of the feed motor.

When the thickness of the sliver exceeds a maximum or minimum value, an indication is given by circuit 16 or 18 and stop circuit 40 prevents further current flow through the armature by controlling drive circuit 38. Positive voltage appears at the junction between resistors 210 and 212 (FIG. 2*b*) whenever one of the amplifiers 214 or 216 associated with the maximum or minimum indicating circuits 18 and 16, respectively, produces an output. The output of amplifier 216 is applied to transistor 220 which shifts to its conductive condition to permit current flow through a conventional indicator 222 such as light emitting diode or other structure when a maximum thickness is exceeded. Similarly, when amplifier 214 produces an output, transistor 224 shifts to its conductive condition permitting current flow through the minimum indicator 226.

The junction between resistors 210 and 212 is connected to the positive input to operational amplifier 230 (FIG. 2*d*). The output of operational amplifier 230 is in turn connected to operational amplifier 232. The output of amplifier 232 is applied by rectifying diode 234 and switch 236 to the base of transistor 240. When conductive, transistor 240 grounds the base to transistor 242 preventing that transistor from shifting into its conductive condition and preventing current flow through winding 246 which is coupled to armature winding 248.

As noted above, the positive input of operational amplifier 200 is connected to the output of operational amplifier 174 while the negative input is connected to the output of the ramp circuit 34. Operational amplifier 250 (FIG. 2*c*) in ramp circuit 34 forms a squaring circuit that delivers output peaks at the zero crossover of the 120 pulse per second ripple signal established by diodes 252 and 254 which are connected to the line voltage. This pulsating D.C. voltage is applied through resistors 256 and 258 to operational amplifier 250. Resistors 256 and 258 establish the threshold bias for amplifier 250 which functions as a comparator to produce a positive pulse each time that the A.C. signal is less than the bias voltage. The width of this pulse is dependent upon the values of resistors 256 and 258, and is typically less than 50 micro-seconds. The pulses are precisely spaced, for example, at 8.33 millisecond intervals. The output of the comparator is applied to a conventional integrator including operational amplifier 260. When the output of operational amplifier 250 is at zero volts, a ramp is produced at the output of the integrator operational amplifier 260. The integrator is allowed to produce this ramp for a period of 8.33 milliseconds at which time the positive pulse from operational amplifier 250 resets the integrator by shunting the charge accumulated on capacitor 262.

The ramp signal is applied to the negative input to operational amplifier 200 which thus functions as a comparator. The output of operational amplifier 200 is a D.C. voltage representing the desired motor speed and is a rectangular waveform with pulses having a duration proportional to the desired speed.

When the ramp input to the operational amplifier 200 exceeds the voltage representing speed, the output of operational amplifier 200 goes to zero volts. This output is inverted by transistor 270 (FIG. 2*d*) and applied to the current buffing transistor 242 as a positive going signal. Buffer transistor 242 conducts current through the winding 246 which induces current in winding 248.

The circuit of the present invention provides high accuracy and a fine degree of speed control to maintain constant sliver density. It is believed that with such a unit, that one percent speed regulation for a permanent magnet field D.C. motor can be achieved. This regulation is sufficient to maintain sliver variation within plus or minus two percent on a long term basis.

Many changes and modifications in the above described embodiment can, of course, be carried out without departing from the scope of the invention. Accordingly, that scope is intended to be limited only by the scope of the appended claims.

What is claimed is:

1. A circuit for producing an electrical control signal for controlling the speed of a first roller driven by a first motor in an apparatus for producing a sliver of uniform density, which apparatus includes means for producing a signal indicating sliver thickness and a second roller driven by a second motor so that the speed difference between the rollers determines sliver thickness comprising:

means for producing a first signal which varies as a function of sliver thickness;

means for producing a second signal which varies as a function of the speed of the first roller;

means for producing a third signal which varies as a function of the speed of the second roller;

means for producing a fourth signal which varies as a function of the difference between said second and third signals;

means for producing a sixth signal which varies as a function of the torque of one of said motors;

means for combining said sixth, fourth and first signals to produce a control signal;

means for generating a train of ramp signals; and means for comparing said ramp signal and said control signal to produce a drive signal for driving one of said motors.

2. A circuit as in claim 1, wherein said first signal producing means includes a coil, means for rectifying the output of said coil, capacitor means for smoothing the current induced in said coil, means for limiting the charging rate of said capacitor means, and a first amplifier.

3. A circuit as in claim 2, wherein said first signal producing means further includes an operational amplifier connected as a high input impedance buffer and an integrator comprising a capacitor and resistor connecting the output of said first amplifier to the input to said operational amplifier.

4. A circuit as in claim 3, including a meter connected to the output of said operational amplifier.

5. A circuit as in claim 4, including switch means for disconnecting said first signal producing means from said combining means.

6. A circuit as in claim 1, wherein said one roller is a feed roller.

7. A circuit as in claim 1, including maximum means for comparing the value of said first signal to a first predetermined value and producing an indication whenever said value of said first signal exceeds said first predetermined value.

8. A circuit as in claim 1, including minimum means for comparing the value of said first signal to a second predetermined value and producing an indication whenever said value of said first signal is less than said second predetermined value.

9. A circuit as in claim 1, wherein said ramp signals generating means includes means for producing a pulsating D.C. voltage, means for comparing said D.C. voltage with a threshold bias and producing a pulse each time said D.C. voltage is less than said bias voltage, means for integrating the pulses and means for resetting said integrating means after a given number of pulses.

10. A circuit as in claim 1, further including circuit breaker means connected to said sixth signal producing means for disconnecting said one motor from its power source when said sixth signal indicates a torque greater than a predetermined value.

11. A circuit as in claim 1, wherein said second signal producing means includes means for producing a negative D.C. voltage representing the speed of a doff roller, wherein said third signal producing means includes means for producing a positive D.C. voltage representing the speed of a feed roller, wherein said fourth signal producing means includes a resistor connected with said positive voltage at one end, said negative voltage at the other end, and wherein said combining means includes a first operational amplifier having one input connected to said first signal producing means and to said resistor between its ends.

12. A circuit as in claim 11, wherein said combining means includes a second operational amplifier having one input connected to said sixth signal producing means and a second input connected to the output of said first operational amplifier.

* * * * *